US006244969B1

(12) United States Patent
Murphy et al.

(10) Patent No.: US 6,244,969 B1
(45) Date of Patent: Jun. 12, 2001

(54) ADJUSTABLE BILLIARD TABLE BED SUPPORT

(76) Inventors: Jeffrey G. Murphy, 35 Wayne Eckert, Parachute, CO (US) 41418; Michael T. Stevens, 64 Little Echo, Parachute, CO (US) 41635

( * ) Notice: Subject to any disclaimer, the term of this patent is extended or adjusted under 35 U.S.C. 154(b) by 0 days.

(21) Appl. No.: 09/413,874

(22) Filed: Oct. 7, 1999

(51) Int. Cl.[7] ..... A63D 15/00
(52) U.S. Cl. ..... 473/29; 473/4; 254/100
(58) Field of Search ..... 473/1, 4, 10, 29, 473/31, 33; 254/100; 108/161, 93, 95

(56) References Cited

U.S. PATENT DOCUMENTS

| | | | | |
|---|---|---|---|---|
| 170,557 | * | 11/1875 | Held | 473/29 |
| 1,677,707 | * | 7/1928 | Compton | 473/29 |
| 1,715,631 | * | 6/1929 | Treiber | 473/33 |
| 1,860,215 | * | 5/1932 | Young | 473/29 |
| 2,627,407 | * | 2/1953 | Acland | 473/29 |
| 3,658,328 | * | 4/1972 | Kooker | 473/29 |
| 3,837,298 | * | 9/1974 | Leonhart | 108/161 |
| 4,027,878 | * | 6/1977 | Dadbeh | 473/29 |
| 5,161,797 | * | 11/1992 | Frasca | 473/29 |
| 5,340,083 | * | 8/1994 | Suhy et al. | 254/100 |
| 5,623,792 | * | 4/1997 | Crumpacker | 52/126.7 |
| 5,674,045 | * | 10/1997 | Eckloff et al. | 254/100 |
| 5,839,966 | * | 11/1998 | Eisenhauer et al. | 473/29 |
| 5,875,606 | * | 3/1999 | Jensen | 254/100 |
| 6,132,320 | * | 9/1998 | Sperl et al. | 473/29 |

* cited by examiner

*Primary Examiner*—Stephen F. Gerrity
*Assistant Examiner*—Mitra Aryanpour
(74) *Attorney, Agent, or Firm*—Peter Gibson

(57) ABSTRACT

An upper wood frame member carrying a slate bed is spaced apart from and in parallel to a lower wood frame member. An upper plate is affixed to the bottom surface of the upper frame member with screws through mounting holes. A lower plate is affixed to the upper surface of the lower frame member with screws through mounting holes and has a threaded aperture aligned with a bore through the lower frame member. A vertically adjustable support screw extending downward into the bore is threaded through the threaded aperture and has an axially aligned pin extending upward which fits into a congruent cavity in the upper plate open to the bottom surface. The vertically adjustable support screw has a cap head at the bottom end disposed within the bore through the lower frame member upon which torque may be exerted with a socket wrench. It is suggested that the threaded aperture through the lower plate be provided by a nut aligned with a smooth hole through the lower plate and welded or brazed to the same in order to obtain sufficient threading without undue plate thickness. A reversible ratchet socket wrench readily enables sensitive elevational adjustment in leveling of the bed which is independent of the floor upon which the billiard table stands.

19 Claims, 3 Drawing Sheets

20
21
15
11
19
14
31
19
30
33
10
19
29
13
19
22
25
12
24
34
23
32

ADJUSTABLE BILLIARD TABLE BED SUPPORT

BACKGROUND OF THE INVENTION

1. Field of the Invention

The field of the present invention relates generally to billiard table frame construction, more particularly to such construction incorporating threaded means for leveling the bed, and most specifically to wood frame billiard table construction incorporating threaded means for leveling a slate bed.

2. General Background

Leveling the playing surface of a billiard table is generally regarded as a difficult matter requiring either:

(a) lifting an end of the table and modifying the effective length of a leg, checking for level, and modifying the effective length of a leg again until level is obtained; or (b) lifting the bed of the table from the frame in order to shim between the two.

It is considered that threaded ends to the legs might be used to facilitate the modification of the effective length of the legs, however, such leg ends are not easily constructed to possess the relatively large amount of floor contact area desired of a billiard table, especially one with a slate bed which is generally considered the conditio sine qua non of a good billiard table which is, intentionally, quite massive.

For this reason shimming the legs is considered to be the most prevalent approach to leveling in which case an end of the billiard table must be lifted and the operation is further typically repetitive in obtainment of a level surface. Lifting an end of a billiard table properly requires an appropriate jack and is inherently potentially adverse to the structure of the table as weight is shifted at an angle to the legs on the other end. Lifting the entire table, alternatively, requires elevation of both sides and both ends simultaneously in order to avoid an imbalance which could readily result in damage to the table.

Similar considerations apply to lifting the bed from the frame as the bed, which is preferably slate, is quite massive. Partial disassembly of the table is also required in this approach and both knowledge and experience are considered invaluable in this operation. Lifting an end of the table and modifying leg length is hence considered the more prevalent approach. In either case both a slate bed and a good billiard table are necessarily massive and therefore difficult to lift which is generally considered an obstacle to leveling the playing surface of a good billiard table possessing a slate bed.

Rather than lifting the bed or an end of a billiard table or using threaded leg ends it is considered that threaded means for elevational adjustment in support of the bed could more easily enable effective leveling of the playing surface of a billiard table. While this approach is considered relatively obscure in the current market there are references known utilizing threaded means for elevational adjustment of the bed of a billiard table as discussed immediately below.

3. Discussion of the Prior Art

U.S. Pat. No. 167,540 issued to Joergens for a 'Billiard-Table' on Sep. 7, 1875 discloses the use of winged screws butting against slightly inclined laterally disposed end frame members for the apparent purpose of modifying the elevation of either end of a cast metal frame billiard table.

U.S. Pat. No. 170,557 issued to Held for a 'Billiard-Table' on Nov. 30, 1875 discloses the use of "screws J J', in combination with the frames C C' E and legs D, for leveling the bed of a billiard-table". Each screw is rotatably trapped within a collar fixed to the lower frame C' and threads through a plate mounted on the underside of the upper frame C into a blind cavity to accommodate the vertically displaceable enclosed upper end of the screw which further extends downward below the underside of the lower frame C' in a square cross section apparently intended to facilitate the application of torque by a wrench.

U.S. Pat. No. 1,715,631 issued to Treiber on Jun. 4, 1929 for a 'Game Table' discloses "(v)ertically disposed adjusting screws 12 (which) are screw-threaded through the horizontal" (Column 2, Lines 89–90) members of a lower frame "adapted to abut the lower surface of" (Column 2, Lines 94–95) horizontal members of an upper frame, the frames being comprised of angle iron and other iron bars and sheet metal bolted together.

U.S. Pat. No. 1,860,215 issued to Young on May 24, 1932 for a 'Leveling Device for Pool and Billiard Tables' discloses vertically oriented adjusting screws 40 with "flattened wings 43" for manual application of torque "positioned at intersections of the braces 30 and reenforcing bars 20 (which) at their upper ends are provided with swivel plates 45" affixed to the upper reenforcing bars 20, preferably by extending a reduced portion of the screw through an aperture in the plate which is "headed over to prevent axial displacement" (Column 2, Lines 76–94).

U.S. Pat. No. 3,658,328 issued to Kooker on Apr. 25, 1972 for 'Pool Game Tables and Components For Use Therein' discloses a table of cast concrete construction comprising a lower pedestal section and an upper table top section connected by a central tubular telescoping component through which billiard balls feed and which maintains the upper and lower section in alignment, the upper section being supported by a plurality of vertically oriented leveling screws mounted in the upper end of the lower pedestal section and simply abutting the lower face of the upper table top section.

SUMMARY OF THE INVENTION

Objects of the Present Invention

The encompassing object of the principles relating to the present invention is provision of leveling means for the bed of a billiard table which is easily operated.

Auxiliary objects of the principles relating to the present invention include provision of leveling means for the bed of a billiard table which is:

(a) independent of the condition of the floor surface under the table;

(b) capable of achieving high precision leveling of the bed;

(c) readily applicable to a wood frame construction;

(d) of ample strength for a full inch thick slate bed;

(e) operable at any time without any disassembly of the table;

(f) operable with ordinary, readily available, tools;

(g) durable;

(h) unobtrusive; and (i) economic.

Principles Relating to the Present Invention

In fulfillment of the objectives listed above it is first considered that threaded support means for an upper frame carrying the bed comprises the most effective and elegant approach to the problem addressed. It is secondly considered that the specific contact made between vertically oriented rotatably adjustable threaded extensions, i.e. adjustable support screws, and an upper frame carrying the bed is crucial to the approach.

If the adjustable support screws simply abut a flat surface some other provision to ensure against accidental horizontal displacement of the upper frame relative to a lower frame is necessary. Securing the top ends of the adjustable support screws to the upper frame obstructs disassembly and complicates the mechanism required. If the adjustable support screws thread through an aperture in the upper frame then cavities must be provided in areas of the upper frame to accommodate the variable extension of the adjustable support screws which must further be threaded into the upper frame during placement of the same upon a lower frame.

All of these shortcomings are avoided with use of an adjustable support screw which possesses a central pin projecting axially from a substantially flat nether end together with a substantially flat metal plate possessing an appropriately sized cavity for the pin open on the face abutted. The pin is rotatable within the open cavity and vertically displaceable therein from an aligned disposition directly below. This arrangement facilitates assembly and inhibits accidental horizontal displacement of the upper frame with respect to the lower frame. The weight of the upper frame and bed carried thereby is thus supported by the contact between opposed congruent surfaces including the flat surfaces about the pin and the open cavity of the plate and the top of the pin and cavity bottom.

It is suggested that the flat metal plate with open cavity for the pin be provided with a plurality of through holes, preferably countersunk, for fixing the plate to the bottom surface of the upper frame which is preferably wood and for which wood screws are recommended for attachment. It is also suggested that a substantially flat metal plate be similarly attached to the top surface of a lower wood frame but that this plate have a aperture therethrough of sufficient diameter to permit passage of the full diameter of one adjustable support screw and that female threading be provided for engaging the same. This through aperture may be tapped for the adjustable support screw or, preferably, aligned with a nut rigidly affixed to the plate sized for the adjustable support screw which allows use of a relatively thin plate while providing ample female threading for support of the considerable load intended to be born thereby. Welding or brazing of the nut to the plate is specifically recommended as is the use of steel.

In order to avoid any projections from the frame such as the head of a screw, which can easily snag a garment or inflict injury if collided with, it is further suggested that the lower frame be provided with a vertical bore therethrough of a diameter sufficient to admit both a hexagonal head of an adjustment support screw and a socket for exerting torque upon the same so that the head of the adjustment support screw is enclosed and torque may readily be exerted upon the same in either direction with a reversible ratchet type socket wrench, perhaps using an extension for the socket.

It is further recommended that six adjustable support screws be utilized, one proximate each corner and a pair located on either side medial to the ends of the table. A diameter of between one half and one inch is recommended for each adjustable support screw, with a pin possessing a reduced diameter extending a distance approximately equal to that reduced diameter. A total of six such adjustable support screws, six upper plates, and six lower plates constructed as described above and attached to an upper and lower wood frame of a billiard table as described above preferably possessing a slate bed of about one inch thickness is recommended in preferred fulfillment of the principles relating to the present invention.

NOMENCLATURE

| | |
|---|---|
| 10 | adjustable billiard table bed support |
| 11 | upper plate |
| 12 | lower plate |
| 13 | vertically adj. support screw |
| 14 | congruent cavity |
| 15 | bottom face of 11 |
| 16 | mounting hole through 11 |
| 17 | countersink about 16 |
| 19 | wood screws |
| 20 | slate bed |
| 21 | upper frame member |
| 22 | lower frame member |
| 23 | bore through 22 |
| 24 | aligned nut |
| 25 | bottom face of 12 |
| 26 | mounting hole through 12 |
| 27 | countersink about 26 |
| 29 | aperture through 12 |
| 30 | axially aligned pin |
| 31 | nether end of 13 |
| 32 | accessible end of 13 |
| 33 | external threading |
| 34 | internal threading |
| 35 | interior sidewall of 14 |
| 36 | exterior sidewall of 30 |
| 37 | nether end face of 30 |
| 40 | blind end face of 14 |

DETAILED DESCRIPTION OF THE PREFERRED EMBODIMENTS

Figure 1:
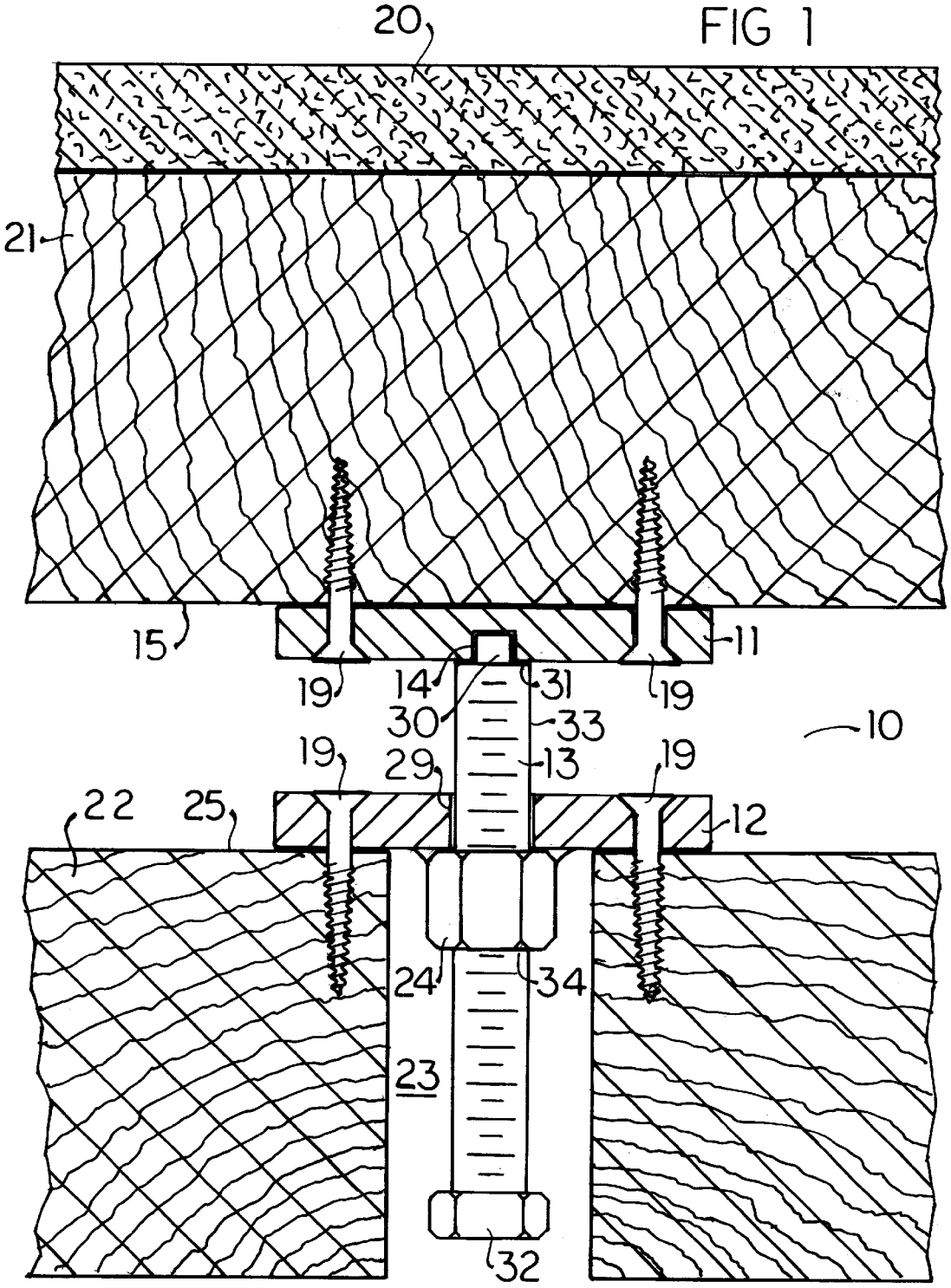
FIG. 1 is an elevational view taken from the side of a preferred embodiment in accordance with the principles relating to the present invention wherein a slate bed, upper wood frame, lower wood frame, upper plate and lower plates are shown in cross section and wood screws attaching the plates, a vertically adjustable support screw, and nut are shown in plain view.

FIG. 1 depicts an adjustable billiard table bed support 10 in preferred accordance with the principles relating to the present invention comprising upper and lower frame members 21, 22, a substantially flat, rigid, upper plate 11, attached by wood screws 19, a substantially flat, rigid, lower plate 12, attached by wood screws 19, and a vertically adjustable support screw 13 possessing a axially aligned pin 30 extending upward from the nether end 31 of the same which engages a congruent cavity 14 open to the bottom face 15 of the upper plate 11. The vertically adjustable support screw 30 has external threading 33 which mates the internal threading 34 of an aperture 29 through the bottom plate 12 which, in the most preferred embodiment depicted in FIG. 1, is provided by a nut 24 affixed to the bottom surface 25 of the bottom plate 12 by welding or brazing and aligned with a smooth bore through the bottom plate 12 which together form a threaded aperture 29 with internal threading 34 mating the external threads 33 of the vertically adjustable support screw 13.

The threaded aperture 29 might alternatively comprise an aperture drilled through the bottom plate 12 of appropriate diameter and then tapped to possess internal threading 34 mating the external threading 33 of the vertically adjustable screw 13 rather than the threaded bore of the aligned nut 24 depicted. The aligned nut 24 is preferred in order to obtain a sufficient amount of internal threading 34 without using an inordinately thick bottom plate 12. It is considered as easy to weld the aligned nut 24 with a smooth aperture through the bottom plate 12 as it is to tap a hole through of sufficient length and by utilizing plate stock of considerably lesser thickness than otherwise required the overall cost is substantially reduced. The preferred thread diameter is ¾"—20 and the aligned nut 24 for this thread is nearly an inch thick or twice the thickness of the plate stock preferred. A simple collar could of course be affixed to the lower plate 12 in the manner of the aligned nut 24 shown and the resultant aperture tapped entirely through which would be even more economic of material but not of time and therefore of expense.

As further seen in FIG. 1 the vertically adjustable support screw 13 extends downward through the bottom plate 12 and the aligned nut 24 terminating in an accessible end 32 to which torque may be readily applied and which, in this preferred embodiment, is comprised of an ordinary hexagonal cap head which is enclosed in a bore 23 through a lower frame member 22 but is readily accessible to an extended socket head of a rachet wrench. The recommended vertically adjustable support screw 13 has an outside diameter of 0.75" and while an appropriate hexagonal aligned nut 24 will have a slightly greater width than the preferred hexagonal cap head end 32 the latter requires engagement by a socket and clearance for this determines the minimum diameter required of the bore 23 through the lower frame member 22.

It is considered that the socket likely to be utilized for a vertically adjustable support screw 13 with the external threading 33 recommended will be 15/16", as measured across opposed flats, and hence the overall diameter of the socket will exceed one inch and a bore 23 of 1.25" to 1.50" is considered appropriate. Given this aspect of the construction it is recommended that the lower frame member 22 be considerably thicker than the bore 23 and a thickness of four inches is specifically suggested for the lower frame member 22 as well as for the upper frame member 21 which is further given a recess of the inside corner in order to provide a lip about the slate bed 20 supported thereby which is preferably a full inch thick in order to provide the characteristics desired of a good billiard table.

Figure 2:
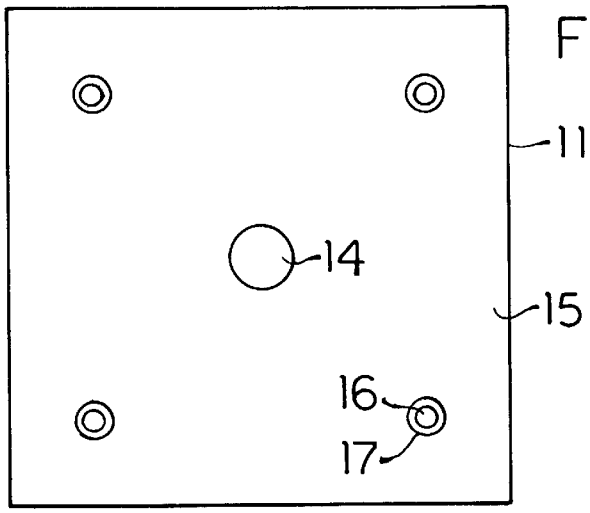
FIG. 2 is a plain elevational view taken from the bottom of a preferred upper plate in accordance with the principles relating to the present invention.
Figure 3:
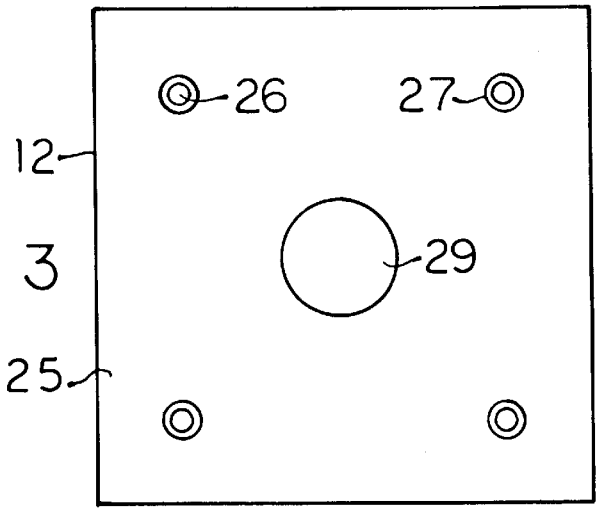
FIG. 3 is a plain elevational view taken from the top of a preferred lower plate in accordance with the principles relating to the present invention.
Figure 4:
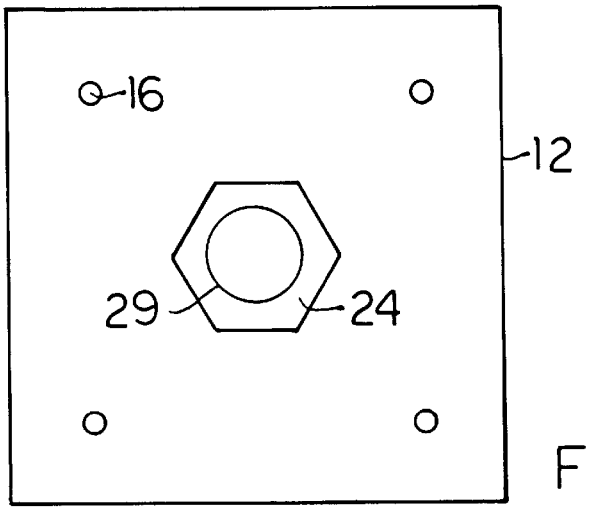
FIG. 4 is a plain elevational view taken from the bottom of a preferred lower plate in accordance with the principles relating to the present invention.

It is further recommended that both the upper and lower plates 11, 12 have mounting holes 16, 26 drilled therethrough as seen in FIGS. 2–4 and it is further recommended that each possess countersinking 17, 27 in order to provide flush disposition of wood screws 19 located therethrough and screwed into the upper and lower frame members 21, 22 as seen in FIG. 1 which comprises the preferred means of fixing each plate 11, 12. The upper plate 11 is necessarily mounted to the lower face of the upper frame member 21 and hence the countersinking 17, along with the congruent cavity 14, is open upon what is termed herein as the bottom face 15 of the upper plate 11 as seen in FIG. 2. The opposed upper face is disposed flush against the lower face of the upper frame member 21 and has only the four mounting holes 16 opening thereto in the preferred embodiment.

The lower plate 12 is mounted on top of the lower frame member 22 in the preferred embodiment depicted in FIG. 1. The bottom face 25 of the lower plate 12 in this case is disposed flush to the upper face of the lower frame member 22 and has the aligned nut 24 affixed to the same bottom surface 25 in order to conceal the same within the bore 23 in the lower frame member 22. Obviously this aligned nut 24 could be affixed to the opposed upper face of the lower plate 12 and function in accordance with the principles relating to the present invention, however, this configuration is considered inelegant in exposing the aligned nut 24. It is also considered that the lower plate might be disposed upon the bottom face of the lower frame member 22 but this would expose what is termed the accessible end 32 of the vertically adjustable support screw 13 which is considered undesirable. For these reasons it is preferred that the countersinking 27 and the aligned nut 24 appear on opposed faces of the bottom plate 12, as depicted in FIGS. 3 & 4 and implied by FIG. 1.

Figure 5:
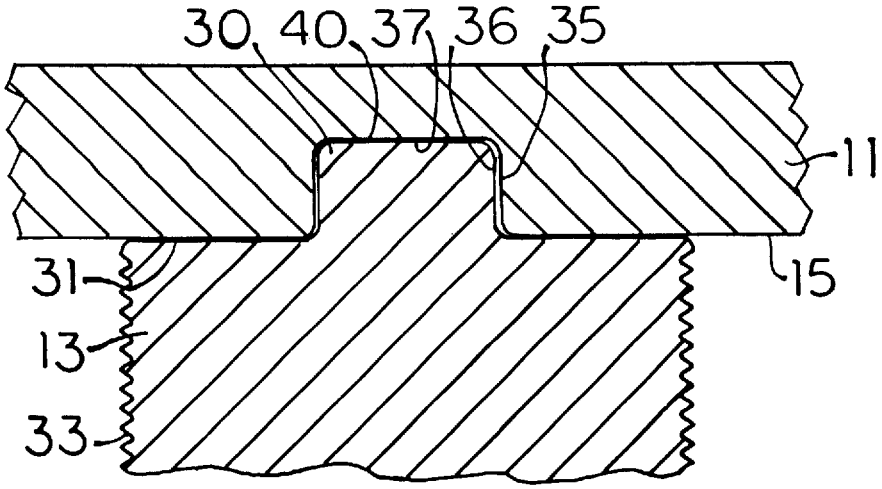
FIG. 5 is a cross sectional view of a medium sized axially aligned pin engaged in a congruent cavity in accordance with the principles relating to the present invention.

The contact between the nether end 31 of the vertically adjustable support screw 13 and the bottom surface 15 of the upper plate 11 including the fit of the axially aligned pin 30 into the congruent cavity 14 is detailed in FIG. 5. The shoulders of both the axially aligned pin 30 and the congruent cavity 14 are chamfered but the interior sidewall 34 of the congruent cavity 14 and the exterior sidewall 36 of the axially aligned pin 30 are vertical and the shape of both is substantially cylindrical. It is further noted that the nether end face 37 of the axially aligned pin 30 and the blind end face 40 of the congruent cavity 14 are substantially horizontal and in contact with each other as is the horizontal nether end 31 of the axially aligned pin 30 and the bottom face 15 of the upper plate 11. In this case the congruent cavity 14 possesses a vertical displacement equal to that of the axially aligned pin 30 and the load upon the vertically adjustable support screw 13 is rather evenly distributed.

Figure 6:
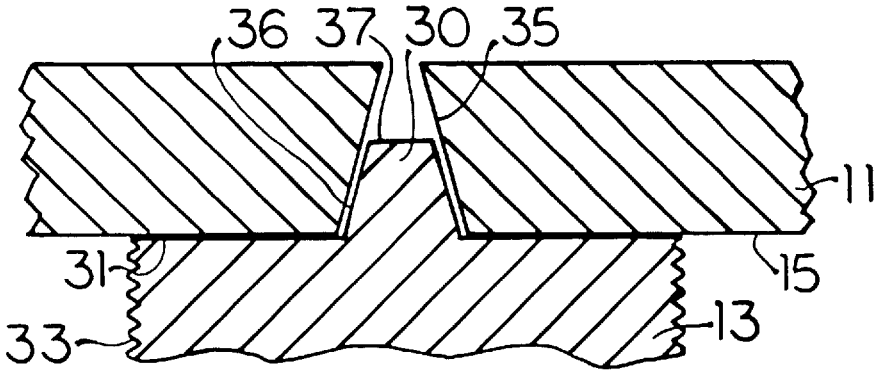
FIG. 6 is a cross sectional view of a small sized axially aligned pin engaged in a congruent cavity in accordance with the principles relating to the present invention.

An alternative shape is depicted in FIG. 6 for both the axially aligned pin 30 and the congruent cavity 14, the former a truncated conical section with a flat nether end face 37, and the latter of similar shape with an interior sidewall 35 substantially parallel to the exterior sidewall 36 of the axially aligned pin 30. The congruent cavity 14 in this case lacks a blind end face 40 and instead comprises a through hole in the upper plate 11 as shown. The flat nether end face 37 of the axially aligned pin 30 does not hence contact the upper plate 11 and does not bear any of the load which is wholly supported by the flat, horizontal, nether end 31 of the vertically adjustable support screw 13 which is in substantially flush disposition with the bottom face 15 of the upper plate 11. The diameter of the axially aligned pin 30 in this case is also seen to be much smaller than the previous configuration.

Figure 7:
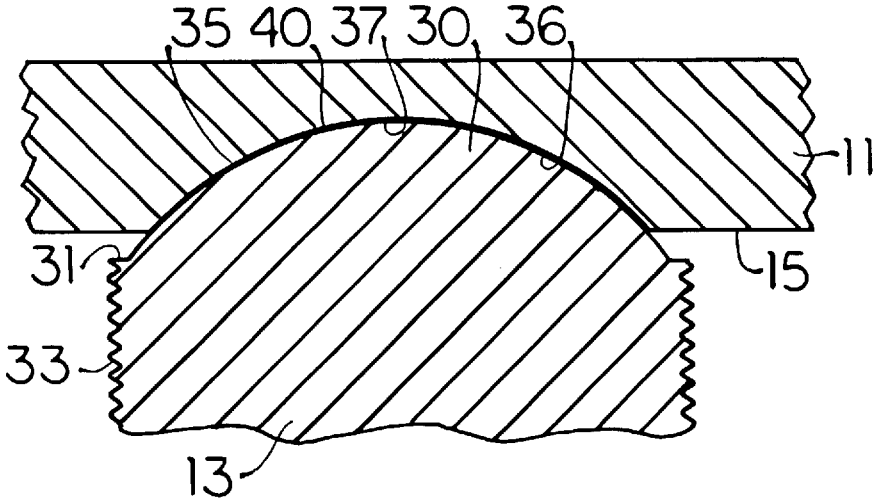
FIG. 7 is a cross sectional view of large axially aligned pin engaged in a congruent cavity in accordance with the principles relating to the present invention.

FIG. 7 depicts a rounded, spherical, shape for both the axially aligned pin 30 and the congruent cavity 14, the former being convex, the latter concave. The exterior sidewall 36 and nether end face 37 of the axially aligned pin 30 are subsumed into one convex surface. Similarly the interior sidewall 35 and the blind end face 40 of the congruent cavity 14 are subsumed into one concave surface. Both of these single surfaces are in substantially flush disposition with each other and it is further noted that the nether end face 37 of the axially aligned pin 30 bears the full load as the nether end 31 of the vertically adjustable support screw 13 peripheral to the axially aligned pin 30 is minimized and does not contact the bottom surface 15 of the upper plate 11.

In each of the cases discussed above with regard to the contact between the vertically adjustable support screw 13 and the bottom face 15 of the upper plate 11:

(a) the fitting of the axially aligned pin 30 into the congruent cavity 14 open to said bottom face 15 by vertical displacement of the former into the latter is unimpeded;

(b) sufficient load bearing surface for support of a one inch thick slate bed 20 is provided; and (c) resistance to lateral displacement is provided.

It is noted that the last case discussed above is considered to possess a less effective provision of the third aspect listed directly above, resistance to lateral displacement, and that while the concave congruent cavity 14 is readily milled in the bottom surface 15 of the upper plate 11 with a ball cutter, the concave axially aligned pin 30 is not easily machined. For these two reasons it is preferred that both the axially aligned pin 30 and the congruent cavity 14 possess sidewalls which are substantially straight and parallel to each other.

Regardless of the precise shape of the axially aligned pin 30 and the congruent cavity 14 it is emphasized that several variables are concerned which may be decided one way or the other. First, either the congruent cavity 14 is blind or through in which case the nether end face 37 of the axially aligned pin 30 cannot bottom out and cannot bear a load in which case its size is to be minimized. If blind, the nether end face 37 of the axially aligned pin 30 may bottom out against a blind end face 40 of the congruent cavity 14 if the height of the axially aligned pin 30 equals or exceeds the depth of the congruent cavity 14. If this height equals the depth then the load is carried by both the nether end face 37 of the axially aligned pin 30 and the nether end 31 of the vertically adjustable support screw 13. If this height exceeds the depth then the nether end face 37 of the axially aligned pin 30 bears all the load and it is advised that the diameter of the nether end face 37 be maximized in relation to the diameter of the vertically adjustable support screw 13.

With regard to overall construction of a frame in accordance with the principles relating to the present invention it is recommended that six adjustable billiard table bed supports 10 be disposed between upper and lower frame members 11, 12 as depicted in FIG. 1 and described above with one proximate each corner of the table and two placed medially to the ends on each opposed side of the table.

Four mounting holes 16, 26, as shown in FIGS. 2–4, are recommended for affixing the upper and lower plates 11, 12 as described above. Another number of mounting holes 16, 26 may be used but given the preferred use of four inch thick timber for the upper and lower frame members 21, 22 no other number is considered to yield an advantage. Cap head screws might be used instead of wood screws 19 in which case the countersinking 17, 27 is obviously unnecessary but it is preferred, as mentioned earlier, that the construction possess no projections from the frame of the table.

It is largely for this reason that the accessible end 32 of the vertically adjustable support screw 13 is enclosed within the bore 23 through the lower frame member 22. Given four inches thickness for the same a length of four to six inches is suggested for the vertically adjustable support screw 13. Depending upon the position of the accessible end 32 of said screw 13 within said bore 23 and given the recommended use of a hexagonal cap head as said accessible end 23 an extension upon a socket may be necessary for operation. With the use of a reversible ratchet wrench and attached socket and extension if necessary elevational adjustment in either direction is readily obtained.

Given the recommended use of a ¾"—20 external threading 33 upon the vertically adjustable support screw 13 twenty threads per inch is provided. This translates into a sensitivity of one twentieth of an inch (0.050") per revolution. A quarter revolution yields an elevational adjustment of 0.0125". If a vertically adjustable support screw 13 with external threading 33 of only 10 TPI is utilized the adjustment effected with a quarter revolution is 0.025". The sensitivity provided by threading within this range is considered to provide relatively precise elevational adjustment capabilities in conjunction with use of an ordinary level of at least two feet length, a length of four feet being preferred. Obviously operation is optimized with two people, one watching the level and the other adjusting with the wrench, but one person can readily and easily adjust the table alone.

The foregoing is intended to provide one practiced in the art with what is considered the best manner of making and using an adjustable billiard table bed support in accordance with the principles relating to the present invention; it is restrictive of neither the invention disclosed herein nor the rights and privileges granted by Letters Patent for which we claim:

1. An adjustable billiard table bed support comprising:

substantially horizontal upper wood frame member bearing a billiard table bed and a substantially horizontal lower wood frame member spaced apart from and substantially parallel to said upper wood frame member, said lower wood frame member further having a substantially vertical bore therethrough;

a substantially flat rigid lower plate possessing a plurality of mounting holes therethrough and a threaded aperture therethrough possessing internal threads and aligned with said bore through said lower wood frame member, said lower plate being attached to said lower wood frame member with a plurality of mounting screws each extending through one said mounting hole and threaded into said lower wood frame member;

a vertically adjustable support screw possessing external threading mating the internal threading of said threaded aperture of said lower plate, an accessible end engageable by a socket by which torque may be exerted with a socket wrench disposed within said substantially vertical bore through said lower wood frame member, and a nether end disposed above said lower wood frame member having an axially aligned pin projecting upward therefrom;

a substantially flat rigid upper plate possessing a plurality of mounting holes therethrough, a lower face, and a cavity congruent in size and shape to said axially aligned pin open to said lower face, said upper plate being attached to said upper wood frame member with a plurality of mounting screws each extending through one said mounting hole and threaded into said upper wood frame member disposing said congruent cavity directly above said axially aligned pin which, vertically displaced into said congruent cavity, provide resistance against lateral displacement of said upper wood frame member with respect to said lower wood frame member with said vertically adjustable support screw bearing the load of said billiard table bed at an elevation which is readily adjustable with the exertion of torque upon said accessible end by a socket wrench.

2. The adjustable billiard table bed support of claim 1 further possessing countersinking about the mounting holes through the upper and lower plates.

3. The adjustable billiard table bed support of claim 1 wherein said accessible end of said vertically adjustable support screw is comprised of a hexagonal cap head.

4. The adjustable billiard table bed support of claim 1 wherein said accessible end of said vertically adjustable support screw is enclosed in said bore through said lower wood frame member.

5. The adjustable billiard table bed support of claim 1 wherein said threaded aperture through said lower plate is comprised of a smooth hole through said lower plate aligned with a nut affixed to said lower plate.

6. The adjustable billiard table bed support of claim 5 wherein said nut is affixed to a bottom face of said lower plate.

7. The adjustable billiard table bed support of claim 1 wherein said external threading between said nether and accessible ends of said vertically adjustable support screw possesses an outside diameter of between one half inch and one full inch.

8. The adjustable billiard table bed support of claim 7 wherein said external threading between said nether and accessible ends of said vertically adjustable support screw possesses an outside diameter of approximately three-quarters of an inch.

9. The adjustable billiard table bed support of claim 1 wherein said external threading between said nether and accessible ends of said vertically adjustable support screw possesses at least ten threads per inch.

10. The adjustable billiard table bed support of claim 9 wherein said external threading between said nether and accessible ends of said vertically adjustable support screw possesses at least twenty threads per inch.

11. The adjustable billiard table bed support of claim 1 wherein said congruent cavity open to said bottom face of said upper plate comprises a through hole and the nether end of said vertically adjustable support screw exclusive of said axially aligned pin bears the full load supported thereby.

12. The adjustable billiard table bed support of claim 11 wherein said congruent cavity open to said bottom face of said upper plate and said axially aligned pin possess a substantially cylindrical shape.

13. The adjustable billiard table bed support of claim 11 wherein said congruent cavity open to said bottom face of said upper plate and said axially aligned pin possess a truncated conical shape.

14. The adjustable billiard table bed support of claim 1 wherein: said axially aligned pin possesses a given height; and said congruent cavity open to said bottom face of said upper plate is blind, open only to said bottom face, and possesses a blind end face.

15. The adjustable billiard table bed support of claim 14 wherein said congruent cavity possesses a concave shape and said axially aligned pin possesses a convex shape.

16. The adjustable billiard table bed support of claim 14 wherein said congruent cavity possesses a substantially cylindrical shape.

17. The adjustable billiard table bed support of claim 14 wherein said congruent cavity possesses a depth greater than said given height of said axially aligned pin.

18. The adjustable billiard table bed support of claim 14 wherein said congruent cavity possesses a depth as great as said given height of said axially aligned pin.

19. The adjustable billiard table bed support of claim 18 wherein said congruent cavity possesses a substantially flat blind face and said axially aligned pin possesses a substantially flat nether end face.

* * * * *